US010339873B2

(12) United States Patent
Hong

(10) Patent No.: US 10,339,873 B2
(45) Date of Patent: Jul. 2, 2019

(54) ORGANIC LIGHT EMITTING DISPLAY DEVICE, CONTROLLER, AND METHOD FOR DRIVING THEREOF

(71) Applicant: LG DISPLAY CO., LTD., Seoul (KR)

(72) Inventor: Moo Kyoung Hong, Paju-si (KR)

(73) Assignee: LG Display CO., Ltd., Seoul (KR)

( * ) Notice: Subject to any disclaimer, the term of this patent is extended or adjusted under 35 U.S.C. 154(b) by 126 days.

(21) Appl. No.: 15/685,956

(22) Filed: Aug. 24, 2017

(65) Prior Publication Data

US 2018/0061327 A1 Mar. 1, 2018

(30) Foreign Application Priority Data

Aug. 30, 2016 (KR) ..... 10-2016-0110622

(51) Int. Cl.

| | |
|---|---|
| ***G09G 3/3275*** | (2016.01) |
| ***G09G 3/3233*** | (2016.01) |
| ***G09G 3/20*** | (2006.01) |
| ***G09G 5/18*** | (2006.01) |

(52) U.S. Cl.

CPC ..... *G09G 3/3275* (2013.01); *G09G 3/2096* (2013.01); *G09G 3/3233* (2013.01); *G09G 5/18* (2013.01); *G09G 2300/0452* (2013.01); *G09G 2300/08* (2013.01); *G09G 2330/10* (2013.01); *G09G 2330/12* (2013.01)

(58) Field of Classification Search

CPC .. G09G 3/3275; G09G 3/2096; G09G 3/3233; G09G 5/18; G09G 2300/0452; G09G 2300/08; G09G 2330/10; G09G 2330/12

See application file for complete search history.

(56) References Cited

U.S. PATENT DOCUMENTS

| | | | | |
|---|---|---|---|---|
| 2017/0047002 | A1* | 2/2017 | Xuan | G09G 3/32 |
| 2017/0047003 | A1* | 2/2017 | Kim | G09G 3/3233 |
| 2017/0047004 | A1* | 2/2017 | Yoon | G09G 3/3233 |
| 2017/0047005 | A1* | 2/2017 | Jinta | G09G 3/3233 |

* cited by examiner

*Primary Examiner* — Sejoon Ahn

(74) *Attorney, Agent, or Firm* — Seed Intellectual Property Law Group LLP

(57) ABSTRACT

The present exemplary embodiments relate to devices and methods of processing data obtained by sensing a characteristic parameter of a sub pixel. A controller which receives a first clock signal and sensing data output from a data driver generates a second clock signal having a same phase as the first clock signal and outputs image data that is compensated based on the sensing data in accordance with the generated second clock signal to the data driver. By doing this, the controller generates the second clock signal using a part of the first clock signal output from the data driver and transmits the image data so that a skew or signal distortion which may be generated at the time of transmitting/receiving data is suppressed to improve sensing and compensation precision and suppress an image abnormality due to the sensing and compensation failure.

11 Claims, 10 Drawing Sheets

ORGANIC LIGHT EMITTING DISPLAY DEVICE, CONTROLLER, AND METHOD FOR DRIVING THEREOF

CROSS-REFERENCE TO RELATED APPLICATIONS

This application claims priority from Korean Patent Application No. 10-2016-0110622, filed on Aug. 30, 2016, which is hereby incorporated by reference for all purposes as if fully set forth herein.

BACKGROUND

Technical Field

The present exemplary embodiments relate to an organic light emitting display device, a controller included in an organic light emitting display device, and a driving method of a controller.

Description of the Related Art

An organic light emitting display device which is getting attention as a display device in recent years uses a self-emitting organic light emitting diode OLED. Such an organic light emitting display device has a high response speed and is advantageous in terms of a contrast ratio, emission efficiency, brightness, and a viewing angle.

Such an organic light emitting display device displays an image by disposing sub pixels which include organic light emitting diodes OLED and driving transistors for driving the OLEDs in a matrix and controlling a brightness of a sub pixel selected by a scan signal according to a gray scale of data.

However, circuit elements such as the organic light emitting diodes OLED and the driving transistors may become degraded as a driving time elapses.

When the organic light emitting diodes OLED or the driving transistors included in the sub pixel are degraded, a unique characteristic parameter of each circuit element, such as a threshold voltage or mobility may also be changed.

Due to the changed characteristic parameter of the circuit elements, the sub pixel including the circuit element may not precisely represent the brightness according to the gray scale of the data, which may cause an overall image abnormality of an image displayed through an organic light emitting display panel.

Therefore, a technology which senses the characteristic parameter of the circuit element included in the sub pixel and performs compensation in accordance with the sensing result has been developed and applied.

However, an error may be incurred during a process of measuring and transmitting sensing data for the characteristic parameter of the circuit element and the error may hinder precise sensing and compensation to cause sensing and compensation failure.

BRIEF SUMMARY

An object of the present exemplary embodiments is to provide an organic light emitting display device which precisely senses and compensates a characteristic parameter of a circuit element disposed in each sub pixel of the organic light emitting display device.

Another object of the present exemplary embodiments is to provide an organic light emitting display device which suppresses a skew that may be generated when sensing data for a characteristic parameter of a circuit element disposed in a sub pixel is transmitted.

Another object of the present exemplary embodiments is to provide an organic light emitting display device which suppresses distortion of sensing data caused by an external noise when sensing data for a characteristic parameter of a circuit element disposed in a sub pixel is transmitted.

According to an aspect of the present exemplary embodiments, there is provided an organic light emitting display device including a display panel including a sub pixel, a data driver coupled to the display panel, and a controller coupled to the data driver. The data driver senses a characteristic parameter of the sub pixel and transmits sensing data to the controller. The controller generates compensation data based on the received sensing data, applies the compensation data to image data, and transmits the compensated image data to the data driver.

In such an organic light emitting display device, the data driver senses the characteristic parameter of the sub pixel disposed in the organic light emitting display device and when the sensing is completed, transmits the first clock signal and the sensing data to the controller. Here, the first clock signal and the sensing data may be transmitted during separate intervals. Alternatively, the data driver may transmit at least a portion of the first clock signal and the sensing data concurrently, or in an overlapping interval.

When the controller receives the first clock signal from the data driver, the controller generates a second clock signal having a same phase as the first clock signal and generates the compensation data based on the sensing data. Further, the controller transmits the compensated image data in accordance with the second clock signal to the data driver.

The controller may generate the second clock signal using the first clock signal received from the data driver.

Further, the controller may generate a synchronization control signal that indicates whether the second clock signal is generated, and the controller may transmit the synchronization control signal to the data driver.

The controller may transmit the synchronization control signal having a low level to the data driver before generating the second clock signal, and may transmit the synchronization control signal having a high level to the data driver when the generation of the second clock signal is completed.

The data driver may output the first clock signal and the sensing data while receiving the synchronization control signal having the low level from the controller and when the synchronization done control signal having the high level is received, the data driver may stop outputting the first clock signal and output only the sensing data.

According to another aspect of the present exemplary embodiments, there is provided a controller including: a receiving unit that receives a first clock signal and sensing data indicative of a sensed characteristic parameter of a sub pixel disposed in an organic light emitting display panel, a clock signal generating unit that generates a second clock signal based on the received first clock signal, a compensating unit that generates compensation data based on the received sensing data, and applies the compensation data to image data, and an output unit that outputs the compensated image data in accordance with the second clock signal to the data driver.

According to still another aspect of the present exemplary embodiments, there is a method including: receiving, by a controller, a first clock signal and sensing data from a data driver, the sensing data indicative of a sensed characteristic parameter of a sub pixel in a display panel; generating a second clock signal based on the first clock signal, the second clock signal having a same phase as the first clock signal; generating compensation data based on the sensing data; applying the compensation data to image data; and outputting the second clock signal and the compensated image data.

According to the present exemplary embodiments, an organic light emitting display device which suppresses a skew generated when sensing data for a characteristic parameter of a sub pixel disposed in an organic light emitting display panel is transmitted to improve sensing and compensating precision may be provided.

According to the present exemplary embodiments, an organic light emitting display device which suppresses distortion of sensing data due to an external noise when sensing data for a characteristic parameter of a sub pixel is transmitted to improve sensing and compensating precision and suppresses failure may be provided According to the present exemplary embodiments, an organic light emitting display device which suppresses sensing and compensation failure for a characteristic parameter of the sub pixel, to suppress image abnormality due to sensing and compensation failure may be provided.

BRIEF DESCRIPTION OF THE SEVERAL VIEWS OF THE DRAWINGS

The above and other aspects, features and other advantages of the present disclosure will be more clearly understood from the following detailed description taken in conjunction with the accompanying drawings, in which.

DETAILED DESCRIPTION

Figure 1:
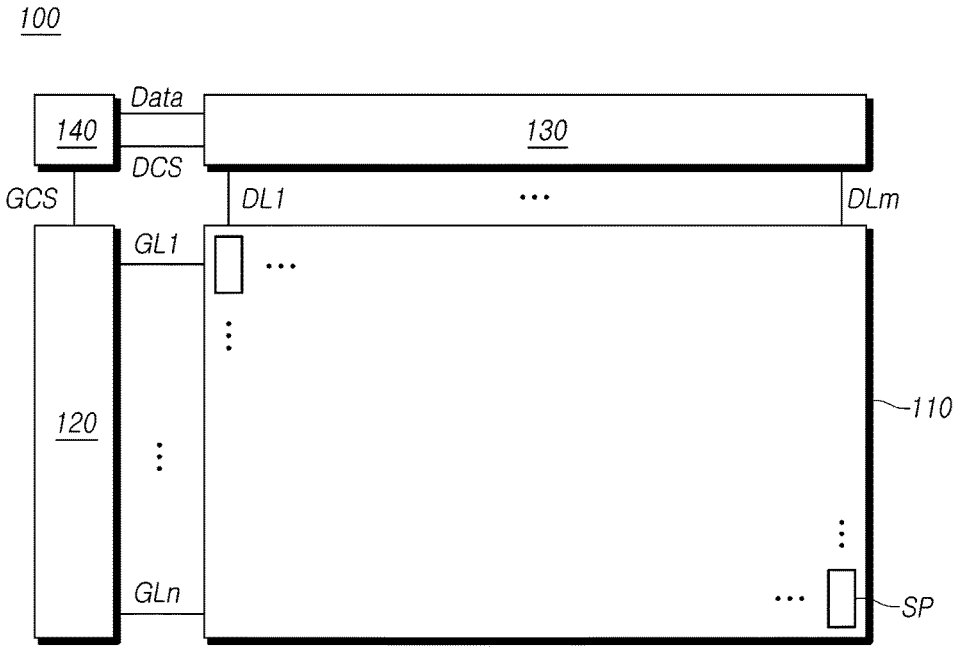
FIG. 1 is a plan view illustrating a schematic configuration of an organic light emitting display device according to the present exemplary embodiments.

Hereinafter, some embodiments of the present disclosure will be described in detail with reference to the accompanying drawings. When reference numerals refer to components of each drawing, although the same components are illustrated in different drawings, the same components are referred to by the same reference numerals as possible. Further, if it is considered that description of a related known configuration or function may otherwise obscure the gist of the present disclosure, then a description of such known configuration or function may be omitted.

Further, in describing components of the present disclosure, terminologies such as first, second, A, B, (a), (b), and the like may be used. The terminologies are used to distinguish one component from another component. However, a nature, an order, a sequence, or the number of components is not limited by the terminologies. If it is described that a component is "connected," "coupled" or "accessed" to or by another component, it is understood that the component may be directly connected to or accessed by the other component, a component may be interposed between the components, or the components may be "connected," "coupled" or "accessed" through another component.

FIG. 1 illustrates a schematic configuration of an organic light emitting display device 100 according to the present exemplary embodiments.

Referring to FIG. 1, the organic light emitting display device 100 according to the present exemplary embodiments includes an organic light emitting display panel 110 in which a plurality of gate lines GL, a plurality of data lines DL, and a plurality of sub pixels SP are disposed, a gate driver 120 which drives the plurality of gate lines GL, a data driver 130 which drives the plurality of data lines DL, and a controller 140 which controls the gate driver 120 and the data driver 130.

The gate driver 120 sequentially drives the plurality of gate lines GL by sequentially supplying scan signals to the plurality of gate lines GL.

The gate driver 120 sequentially drives the plurality of gate lines GL by sequentially supplying ON voltage or OFF voltage scan signals to the plurality of gate lines GL according to the control of the controller 140.

According to a driving method, the gate driver 120 may be located only at one side of the organic light emitting display panel 110 or may be located at both sides thereof.

Further, the gate driver 120 may include one or more gate driver integrated circuits.

Each of the gate driver integrated circuits may be connected to a bonding pad of the organic light emitting display panel 110 through a tape automated bonding (TAB) process or a chip on glass (COG) process. Each of the gate driver integrated circuits may also be implemented as a gate in panel (GIP) type and may be directly disposed in the organic light emitting display panel 110.

Further, each of the gate driver integrated circuits may be integrated to be disposed in the organic light emitting display panel 110 or implemented through a chip on film (COF) process to be mounted on a film connected to the organic light emitting display panel 110.

The data driver 130 drives the plurality of data lines DL by supplying a data voltage to the plurality of data lines DL.

When a specific gate line GL is open, the data driver 130 converts image data received from the controller 140 into an analog data voltage to supply the converted analog data voltage to the plurality of data lines DL, thereby driving the plurality of data lines DL.

The data driver 130 includes at least one source driver integrated circuit to drive the plurality of data lines DL.

Each of the source driver integrated circuits may be connected to the bonding pad of the organic light emitting display panel 110 through a tape automated bonding (TAB) process or a chip on glass (COG) process. Each of the gate driver integrated circuits may also be directly disposed in the organic light emitting display panel 110, or may be integrated to be disposed in the organic light emitting display panel 110.

Further, each of the source driver integrated circuits may be implemented by a chip on film (COF) process. In this case, one end of each of the source driver integrated circuits is bonded to one source printed circuit board and the other end is bonded to the organic light emitting display panel 110.

The controller 140 supplies various control signals to the gate driver 120 and the data driver 130 to control the gate driver 120 and the data driver 130.

The controller 140 starts scanning according to a timing implemented in each frame, and converts input image data input from the outside to be suitable for a data signal form used by the data driver 130 to output the converted image data. The controller 140 controls data driving at a proper time corresponding to the scanning.

The controller 140 receives various timing signals including a vertical synchronization signal Vsync, a horizontal synchronization signal Hsync, an input data enable (DE) signal, and a clock signal CLK together with the input image data, from the outside (for example, a host system).

The controller 140 converts the input image data input from the outside to be suitable for a data signal form used in the data driver 130 to output the converted image data. In addition, in order to control the gate driver 120 and the data driver 130, the controller 140 receives the timing signal such as the vertical synchronization signal Vsync, the horizontal synchronization signal Hsync, the input data enable signal DE, and the clock signal CLK to generate various control signals, thereby outputting the control signals to the gate driver 120 and the data driver 130.

For example, in order to control the gate driver 120, the controller 140 outputs various gate control signals GCS including a gate start pulse GSP, a gate shift clock GSC, and a gate output enable signal GOE.

Here, the gate start pulse GSP controls an operation start timing of one or more gate driver integrated circuits which configure the gate driver 120. The gate shift clock GSC is a clock signal which is commonly input to one or more gate driver integrated circuits and controls a shift timing of the scan signal (gate pulse). The gate output enable signal GOE designates timing information of one or more gate driver integrated circuits.

Further, in order to control the data driver 130, the controller 140 outputs various data control signals DCS including a source start pulse SSP, a source sampling clock SSC, a source output enable signal SOE, and the like.

Here, the source start pulse SSP controls a data sampling start timing of one or more source driver integrated circuits which configure the data driver 130. The source sampling clock SSC is a clock signal which controls a sampling timing of data in each of the source driver integrated circuits. The source output enable signal SOE controls an output timing of the data driver 130.

The controller 140 may be disposed in a control printed circuit board which is connected to a source printed circuit board to which the source driver integrated circuit is bonded, through a connecting medium such as a flexible flat cable FFC or a flexible printed circuit FPC.

In such a control printed circuit board, a power controller (not illustrated) which supplies various voltages or currents to the organic light emitting display panel 110, the gate driver 120, the data driver 130, and the like or controls the various voltages or currents to be supplied may be further disposed. Such a power controller is also referred to as a power management IC.

In the organic light emitting display device 100, each of the sub pixels disposed in the organic light emitting display panel 110 may include circuit elements such as an organic light emitting diode (OLED), two or more transistors, and at least one capacitor.

The type and the number of circuit elements included in each sub pixel may be variously determined in accordance with a function to be provided and a design method utilized.

Figure 2:
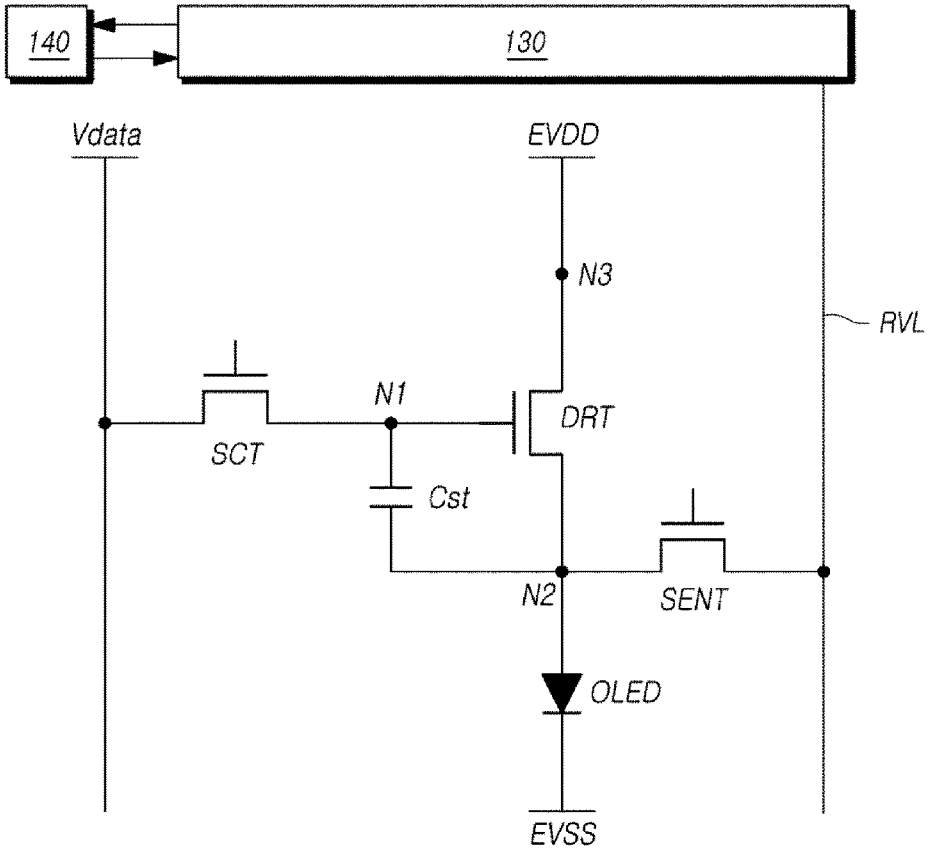
FIG. 2 is a schematic diagram illustrating an example of a sub pixel structure of an organic light emitting display device according to the present exemplary embodiments.

FIG. 2 illustrates an example of a sub pixel structure disposed in an organic light emitting display panel 110 according to the present exemplary embodiments.

Referring to FIG. 2, each sub pixel includes an organic light emitting diode OLED and a driving transistor DRT which drives the organic light emitting diode OLED.

Further, each sub pixel may include a storage capacitor Cst electrically connected between a first node N1 and a second node N2 of the driving transistor DRT, a scan transistor SCT which is controlled by the scan signal and electrically connected between the first node N1 of the driving transistor DRT and a corresponding data line DL, and a sensing transistor SENT electrically connected between the second node N2 of the driving transistor DRT, the reference voltage line RVL, and the like.

The organic light emitting diode OLED is formed by a first electrode (for example, an anode electrode or a cathode electrode), an organic layer, and a second electrode (for example, a cathode electrode or an anode electrode).

For example, the second node N2 of the driving transistor DRT is connected to the first electrode of the organic light emitting diode OLED and a base voltage EVSS may be applied to the second electrode of the organic light emitting diode OLED.

The driving transistor DRT supplies a driving current to the organic light emitting diode OLED to drive the organic light emitting diode OLED. The driving transistor has a first node N1 corresponding to a gate node, a second node N2 corresponding to a source node or a drain node, and a third node N3 corresponding to a drain node or a source node.

The scan transistor SCT transmits a data voltage to the first node N1 of the driving transistor DRT and is electrically connected between the first node N1 of the driving transistor DRT and the data line DL. The scan transistor SCT is turned on by a scan signal which is applied to the gate node to transmit the data voltage to the first node N1 of the driving transistor DRT.

The storage capacitor Cst is electrically connected between the first node N1 and the second node N2 of the driving transistor DRT to maintain a predetermined voltage for one frame.

The sensing transistor SENT is electrically connected between the second node N2 of the driving transistor DRT and the reference voltage line RVL and is controlled by the scan signal which is applied to the gate node of the sensing transistor SENT.

The sensing transistor SENT is turned on to apply a reference voltage Vref supplied through the reference voltage line RVL to the second node N2 of the driving transistor DRT.

Further, the sensing transistor SENT may be used to sense a characteristic parameter (for example, a threshold voltage or mobility) of one or more circuit elements such as an organic light emitting diode OLED or a driving transistor DRT included in the sub pixel.

For example, after floating a voltage of the second node N2 in a state when the sensing transistor SENT is turned off, the sensing transistor SENT is turned on to sense the voltage of the second node N2 through the reference voltage line RVL and measure a characteristic parameter (hereinafter, also referred to as a "characteristic parameter of a sub pixel") of the circuit element.

Sensing data obtained by measuring the characteristic parameter of the circuit element is transmitted from the data driver 130 to the controller 140, and the controller 140 applies compensation data to image data based on the sensing data. The controller 140 outputs compensated image data, i.e., the image data to which the compensation data is applied. Therefore, a change in the characteristic parameter due to deterioration of the circuit element may be compensated.

In this case, when the sensing data for the characteristic parameter of the circuit element is transmitted, a skew of a clock signal and sensing data may be generated or sensing data distortion due to an external noise may be caused.

Errors incurred at the time of transmitting the sensing data causes failure of sensing and compensation and an image abnormality due to the compensation failure may be generated.

The present exemplary embodiments provide an organic light emitting display device 100 which suppresses errors generated at the time of transmitting sensing data for a characteristic parameter of the sub pixel to improve sensing and compensating precision and suppress an image abnormality due to the sensing and compensation failure.

Figure 3:
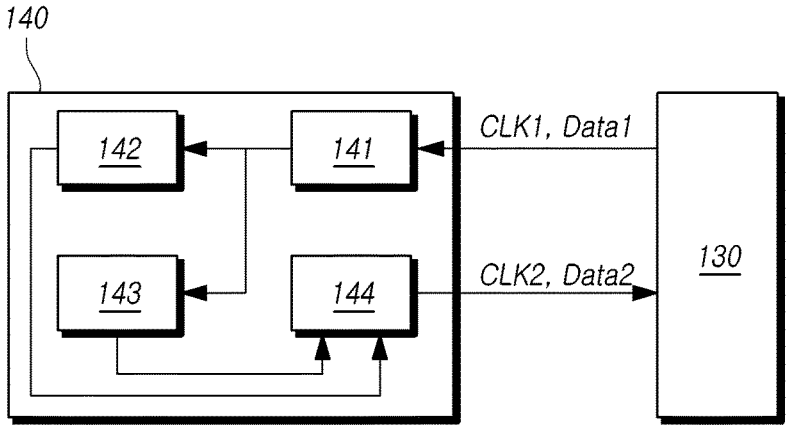
FIG. 3 is a schematic diagram illustrating a configuration of a data driver and a controller in an organic light emitting display device according to the present exemplary embodiments.

FIG. 3 illustrates a configuration of a data driver 130 which transmits sensing data and a controller 140 which receives sensing data and generates compensation data in the organic light emitting display device 100 according to the present exemplary embodiments.

Referring to FIG. 3, the data driver 130 senses a characteristic parameter of a sub pixel through the reference voltage line RVL. When the sensing is completed, the data driver 130 transmits a first clock signal CLK1 and sensing data Data1 to the controller 140.

When the controller 140 receives the first clock signal CLK1 and the sensing data Data1 from the data driver 130, the controller 140 generates a second clock signal CLK2 having the same phase as the first clock signal CLK1 using the first clock signal CLK1.

Further, the controller 140 generates compensation data which compensates the characteristic parameter of the sub pixel based on the sensing data Data1 and transmits image data Data2 to which the compensation data is applied to the data driver 130.

By doing this, a change in the characteristic parameter of the sub pixel due to deterioration of the circuit element disposed in the sub pixel may be compensated and the image abnormality due to the change in the characteristic parameter of the sub pixel may be suppressed.

However, in a case when the data driver 130 does not transmit the first clock signal CLK1, but transmits only the sensing data Data1, the controller transmits data to the data driver 130 using an internal clock signal of the controller 140.

In this case, a skew between the clock signal and the data is generated, which may cause sensing and compensation failure.

Alternatively, the controller 140 may transmit the data to the data driver 130 using the same first clock signal CLK1 that is transmitted by the data driver 130.

In this case, even though the skew between the clock signal and the data may be suppressed, signal distortion due to the external noise is generated, so that sensing and compensation failure may be caused.

The present exemplary embodiments provide a data transmission/reception method which may suppress a skew or signal distortion that may be generated at the time of transmitting/receiving data between the data driver 130 and the controller 140.

Specifically, the data driver 130 transmits sensing data Data1 obtained by sensing a characteristic parameter of the sub pixel to the controller 140 together with the first clock signal CLK1.

In this case, the first clock signal CLK1 may be transmitted during a longer interval than that of the sensing data Data1.

The controller 140 includes a receiving unit 141, a clock signal generating unit 142, a compensating unit 143, and an output unit 144. The compensating unit 142 may be located outside the controller 140.

The receiving unit 141 of the controller 140 receives the first clock signal CLK1 and the sensing data Data1 which are transmitted by the data driver 130.

When the receiving unit 141 receives the first clock signal CLK1 and the sensing data Data1 from the data driver 130, the receiving unit 141 transmits the received first clock signal CLK1 to the clock signal generating unit 142 and transmits the sensing data Data1 to the compensating unit 143.

When the clock signal generating unit 142 receives the first clock signal CLK1 transmitted from the data driver 130, the clock signal generating unit 142 generates a second clock signal CLK2 having the same phase as the first clock signal CLK1 using the received first clock signal CLK1.

The clock signal generating unit 142 suppresses the skew between the clock signal and the data using the first clock signal CLK1 transmitted from the data driver 130 and suppresses the signal distortion caused by the external noise using the second clock signal CLK2 which is generated using the first clock signal CLK1 at the time of transmitting data.

Further, the clock signal generating unit 142 may control output of synchronization control signals having a level which varies depending on whether to generate the second clock signal CLK2. The synchronization control signal may be referred to herein as a "synchronization done control signal," as this signal indicates whether the second clock signal CLK2 is generated, which is synchronized with the first clock signal CLK1.

For example, the clock signal generating unit 142 outputs the synchronization done control signal having a low level before generating the second clock signal CLK2.

When generation of the second clock signal CLK2 is completed, the clock signal generating unit outputs the synchronization done control signal having a high level.

Information indicating whether the second clock signal CLK2 is generated is transmitted to the data driver 130 through output of the synchronization done control signal, so that the data driver 130 may adjust the output of the first clock signal CLK1. That is, the data driver 130 may output the first clock signal CLK1 to the controller 140 based on the level of the second clock signal CLK2.

When the compensating unit 143 receives sensing data Data1 which is transmitted from the data driver 130, the compensating unit 143 generates compensation data based on the sensing data Data1.

Further, the compensating unit 143 outputs image data Data2 to which the compensation data is applied, i.e., to which compensation for the change in the characteristic parameter of the sub pixel is applied.

The output unit 144 transmits image data Data2 to which the compensation data is applied by the compensating unit 143 to the data driver 130 using the second clock signal CLK2 generated by the clock signal generating unit 142.

The output unit 144 transmits data using the first clock signal CLK1 transmitted from the data driver 130 rather than the internal clock signal, so that the skew between the clock signal and the data is not generated. That is, the output unit 144 generates the second clock signal CLK2, which is based on the first clock signal CLK1, and transmits the image data Data2 using the second clock signal CLK2.

Further, the output unit 144 generates the second clock signal having the same phase as the first clock signal CLK1 transmitted from the data driver 130 to transmit data, so that the signal distortion due to the external noise may be suppressed.

The output unit 144 transmits the synchronization done control signal which is controlled by the clock signal generating unit 142 to the data driver 130.

The output unit 144 transmits the synchronization done control signal having a low level to the data driver 130 before generating the second clock signal CLK2 by the clock signal generating unit 142. When the second clock signal CLK2 is generated, the output unit 144 transmits the synchronization done control signal having a high level to the data driver 130.

The data driver 130 outputs the first clock signal CLK1 and the sensing data Data1 while receiving the synchronization done control signal having a low level. When the data driver 130 receives the synchronization done control signal having a high level, the data driver 130 stops outputting the first clock signal CLK1 and outputs only the sensing data Data1.

Accordingly, the controller 140 may generate the second clock signal CLK2 using only some of the first clock signal CLK1 output by the data driver 130 and transmit data in accordance with the generated second clock signal CLK2.

Figure 4:
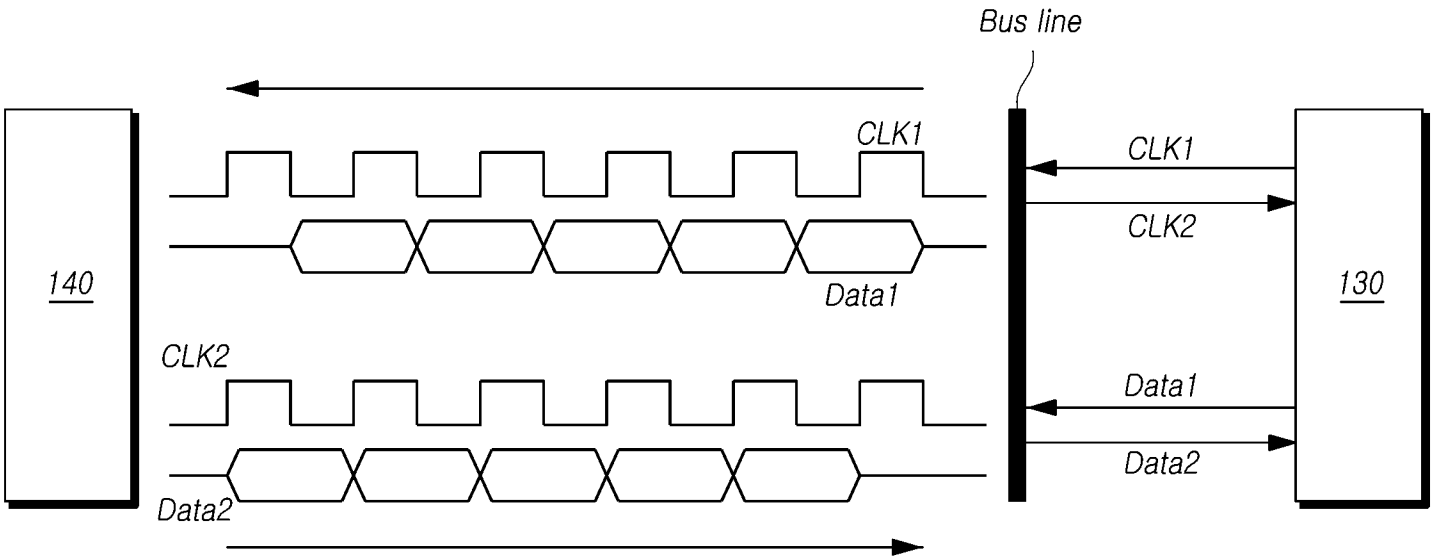
FIG. 4 is a schematic diagram illustrating an example of data transmission between a data driver and a controller in an organic light emitting display device according to the present exemplary embodiments.

FIG. 4 illustrates an example of a clock signal and data transmitted/received between the data driver 130 and the controller 140 according to the present exemplary embodiments.

Referring to FIG. 4, when the data driver 130 completely senses a characteristic parameter of a sub pixel, the data driver 130 transmits a first clock signal CLK1 and sensing data Data1 to the controller 140.

The controller 140 receives the first clock signal CLK1 and the sensing data Data1 from the data driver 130.

The controller 140 transmits data using the first clock signal CLK1 received from the data driver 130, e.g., using the second clock signal CLK2 which is generated based on the first clock signal CLK1. Thus, the controller 140 does not rely on an internal clock signal for transmitting the data. Therefore, a skew which may be caused when the data is transmitted using the internal clock signal is not generated.

When the controller 140 receives the first clock signal CLK1 from the data driver 130, the controller 140 generates a second clock signal CLK2 having the same phase as the first clock signal CLK1, using the received first clock signal CLK1.

The controller 140 generates a second clock signal CLK2 having the same phase as the received first clock signal CLK1 and transmits the data using the generated second clock signal CLK2. That is, the controller 140 does not utilize the same first clock signal CLK1 received from the data driver 130, but instead generates a second clock signal CLK2, using the first clock signal CLK1, and having a same phase as the first clock signal CLK1.

By doing this, it is possible to suppress signal distortion due to the external noise which may be generated when the first clock signal CLK1 transmitted together with the sensing data Data1 from the data driver 130 is used as it is.

The controller 140 may output a synchronization done control signal to the data driver 130 having a level which varies depending on whether the second clock signal CLK2 is completely generated using the first clock signal CLK1.

In this case, the synchronization done control signal may be transmitted through an EPI control packet which is transmitted from the controller 140 to the data driver 130.

The controller 140 receives the first clock signal CLK1 and outputs a synchronization done control signal having a low level before generating the second clock signal CLK2. When the generation of the second clock signal CLK2 is completed, the controller 140 may output a synchronization done control signal having a high level.

When the controller 140 outputs the synchronization done control signal having a high level, the data driver 130 stops outputting the first clock signal CLK1 and outputs only the sensing data Data1.

Therefore, the data driver 130 may stop outputting the first clock signal CLK1. Further even though the controller 140 does not receive the first clock signal CLK1 from the data driver 130, the controller 140 may transmit the data to the data driver 130 using the generated second clock signal CLK2.

Figure 5:
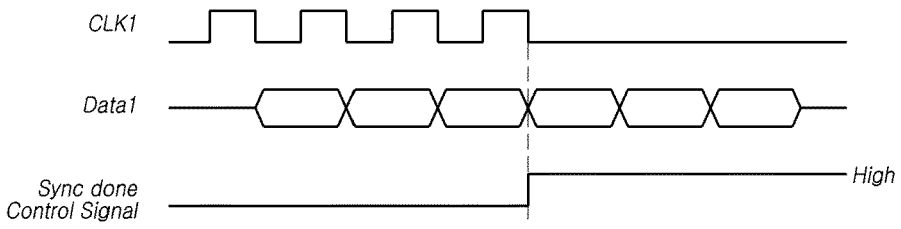
FIGS. 5 and 6 are waveform diagrams illustrating an example of a signal and data output from a data driver and a controller in an organic light emitting display device according to the present exemplary embodiments.
Figure 6:
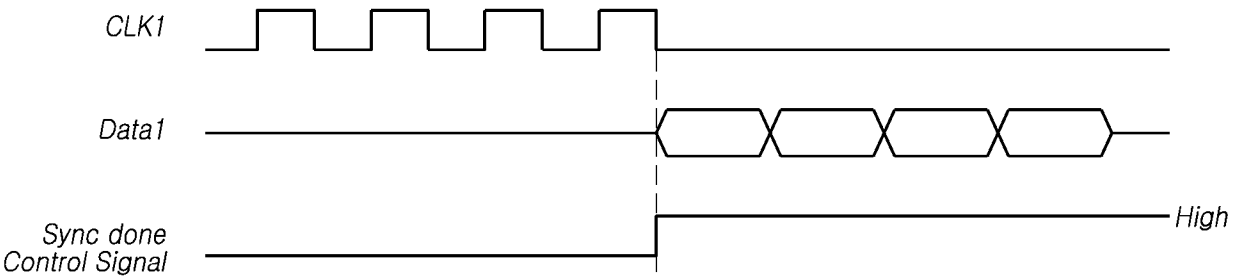

FIGS. 5 and 6 illustrate an example of a signal and data output from the data driver 130 and the controller 140 according to the present exemplary embodiments.

FIG. 5 illustrates that parts of the first clock signal CLK1 and the sensing data Data1 output from the data driver 130 may be output during an overlapping interval.

Referring to FIG. 5, the data driver 130 starts outputting the first clock signal CLK1 and the sensing data Data1 during the same interval.

The controller 140 receives the first clock signal CLK1 and the sensing data Data1 output from the data driver 130 and generates a second clock signal CLK2 having the same phase as the first clock signal CLK1 using the received first clock signal CLK1.

The controller 140 outputs a synchronization done control signal having a level which varies depending on whether the second clock signal CLK2 is generated.

The controller 140 receives the first clock signal CLK1 and outputs a synchronization done control signal having a low level before generating the second clock signal CLK2. When the generation of the second clock signal CLK2 is completed, the controller 140 outputs a synchronization done control signal having a high level.

When the data driver 130 receives the synchronization done control signal having a high level from the controller 140, the data driver 130 stops outputting the first clock signal CLK1.

At this time, the controller 140 outputs data in accordance with the second clock signal CLK2 which is generated using the first clock signal CLK1 which is output by the data driver 130 during a partial interval, so that a skew problem between the clock signal and the data or signal distortion due to the external noise may be suppressed.

FIG. 6 illustrates that the first clock signal CLK1 and the sensing data Data1 output from the data driver 130 may be output in separate intervals.

Referring to FIG. 6, the data driver 130 outputs the first clock signal CLK1 during a longer interval than that of the sensing data Data1.

This means that the first clock signal CLK1 is output over a longer interval than the sensing data Data1 in order to stably output the sensing data Data1 without missing any of the sensing data Data1.

In this case, the controller 140 generates the second clock signal CLK2 using the first clock signal CLK1 received from the data driver 130.

In this case, the controller 140 outputs the synchronization done control signal having a low level before generating the second clock signal CLK2 and when the generation of the second clock signal CLK2 is completed, the controller 140 outputs the synchronization done control signal having a high level.

When the data driver 130 receives the synchronization done control signal having a high level from the controller 140, the data driver 130 stops outputting the first clock signal CLK1 and outputs only the sensing data Data1.

Since the first clock signal CLK1 is output during a longer interval than that of the sensing data Data1, the sensing data Data1 may be output after stopping outputting of the first clock signal CLK1.

Therefore, when the first clock signal CLK1 is output from the data driver 130 during a longer interval than that of the sensing data Data1, the controller 140 may complete the generation of the second clock signal CLK2 using the first clock signal CLK1 which is received before receiving the sensing data Data1.

In this case, when the controller 140 completes the generation of the second clock signal CLK2, the controller 140 outputs the synchronization done control signal having a high level so that only sensing data Data1 is received from the data driver 130. However, the controller 140 may transmit data using the second clock signal CLK2 which is generated using the first clock signal CLK1.

That is, according to the present exemplary embodiments, even though the controller 140 receives only a part of the first clock signal CLK1 output from the data driver 130, the controller 140 may stably output data. By doing this, it is possible to suppress sensing and compensation failure caused by an error generated at the time of transmitting the sensing data Data1.

In the meantime, according to the present exemplary embodiments, the controller 140 suppresses the sensing and compensation failure by generating the second clock signal CLK2 and detects the sensing and compensation failure using a waveform of the synchronization done control signal.

Figure 7A:
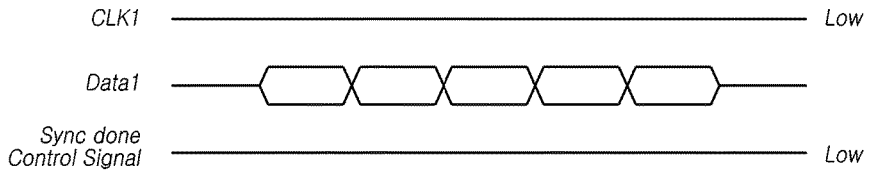
FIGS. 7A and 7B are waveform diagrams illustrating an example of a waveform which detects that the sensing and compensating are improperly performed in an organic light emitting display device according to the present exemplary embodiments.
Figure 7B:
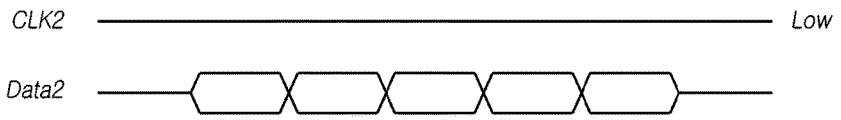

FIGS. 7A and 7B illustrate that the data driver 130 and the controller 140 according to the present exemplary embodiments detect the sensing and compensation failure through a waveform of transmitting/receiving a signal and data.

Referring to FIG. 7A, the data driver 130 outputs only the sensing data Data1 without outputting the first clock signal CLK1.

When the data driver 130 does not output the first clock signal CLK1, the controller 140 may not output the second clock signal CLK2 having the same phase as the first clock signal CLK1.

Referring to FIG. 7B, the controller 140 does not receive the first clock signal CLK1 from the data driver 130, and thus the second clock signal CLK2 is not output by the controller 140. Further, the controller 140 may output image data Data2 to which the compensation data based on the sensing data Data1 received from the data driver 130 is applied.

In this case, sensing and compensation failure occurs so that an image abnormality may be generated on a displayed image.

In this case, when the controller 140 does not receive the first clock signal CLK1 from the data driver 130, the controller 140 does not generate the second clock signal CLK2 so that the controller 140 continuously outputs the synchronization done control signal having a low level.

Therefore, the sensing and compensation failure is detected through the synchronization done control signal which is output by the controller 140. For example, when the controller 140 continuously outputs the synchronization done control signal having a low level, compensation based on the sensing data Data1 received during the corresponding interval may not be applied.

By doing this, it is possible to detect or predict the sensing and compensation failure and suppress the image abnormality due to the sensing and compensation failure.

Figure 8:
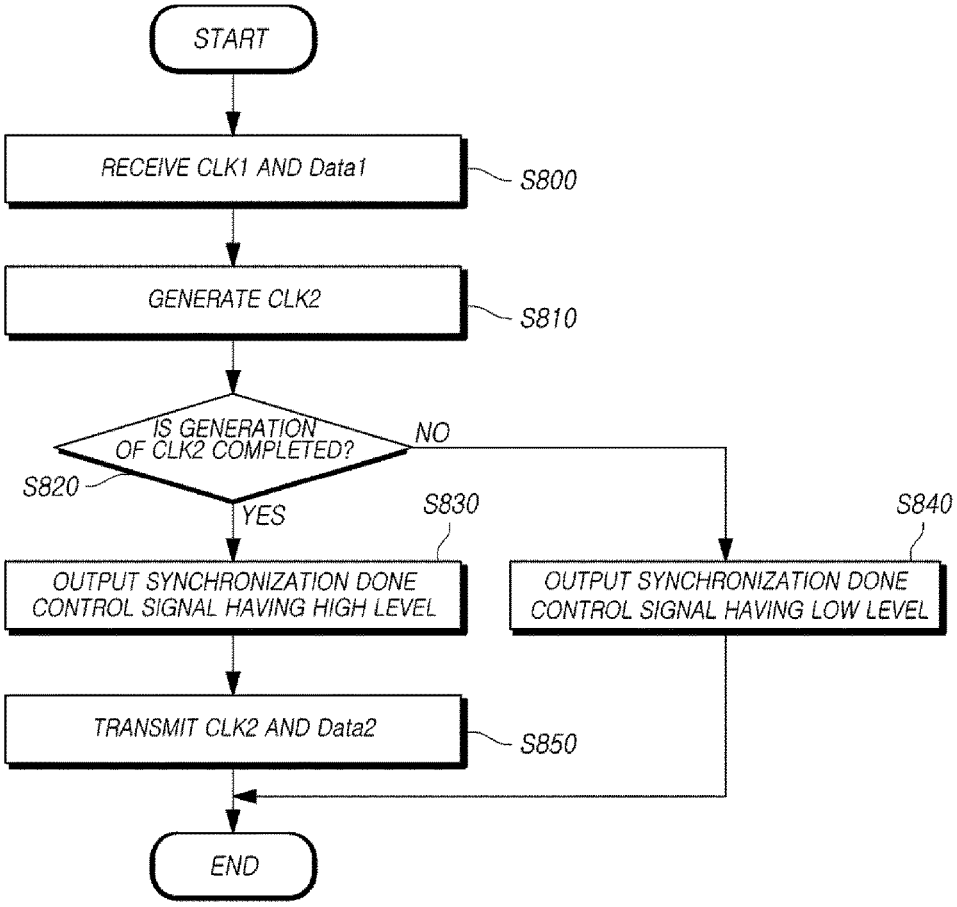
FIG. 8 is a flowchart illustrating a process of a driving method of a controller in an organic light emitting display device according to the present exemplary embodiments.
Figure 9:
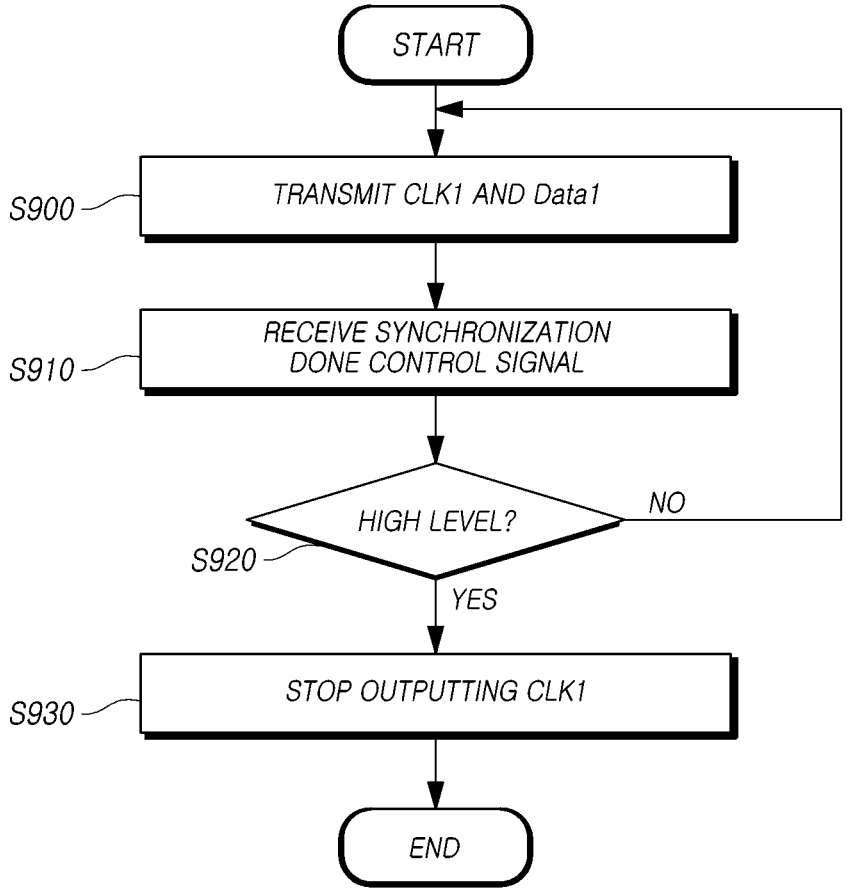
FIG. 9 is a flowchart illustrating a process of a driving method of a data driver in an organic light emitting display device according to the present exemplary embodiments.

FIGS. 8 and 9 illustrate processes of a driving method of a controller 140 and of a data driver 130, respectively, in an organic light emitting display device 100 according to the present exemplary embodiments.

FIG. 8 illustrates a process of a driving method of a controller 140. At S800, the controller 140 receives a first clock signal CLK1 and sensing data Data1 from the data driver 130.

At S810, the controller 140 generates a second clock signal CLK2 having the same phase as the first clock signal CLK1 using the received first clock signal CLK1.

At S820, the controller 140 determines whether the generation of the second clock signal CLK2 is completed. If the generation of the second clock signal CLK2 is completed, then the controller 140 outputs a synchronization done control signal having a high level at S830. On the other hand, if the generation of the second clock signal CLK2 is not completed, then the controller 140 outputs a synchronization done control signal having a low level before completing the generation of the second clock signal CLK2 at S840.

At S850, the controller 140 outputs the generated second clock signal CLK2 and image data Data2 to which compensation based on the received sensing data Data1 is applied to the data driver 130.

FIG. 9 illustrates a process of a driving method of the data driver 130. At S900, the data driver 130 transmits the first clock signal CLK1 and the sensing data Data1 to the controller 140. At S910, the data driver 130 receives a synchronization done control signal from the controller 140.

When the synchronization done control signal received from the controller 140 is a high level, as determined at S920, then the data driver 130 stops outputting the first clock signal CLK1 at S930. On the other hand, when the synchronization done control signal is a low level, as determined at S920, the data driver 130 continues to output the first clock signal CLK1 and the sensing data Data1.

According to the present exemplary embodiments, the controller 140 outputs data in accordance with a second clock signal CLK2 that is generated using the first clock signal CLK1 which is transmitted from the data driver 130 together with the sensing data Data1. Accordingly, a skew between the clock signal and the data may be suppressed.

Further, the controller 140 generates the second clock signal CLK2 having the same phase as the first clock signal CLK1 and uses the second clock signal CLK2 so that signal distortion due to the external noise which may be generated when the first clock signal CLK1 is used as it is may be suppressed.

Further, even though the first clock signal CLK1 is output from the data driver 130 only during a partial interval, the controller 140 generates the second clock signal CLK2 using the first clock signal and transmits the data together with the second clock signal CLK2.

By doing this, a skew or signal distortion which may be generated at the time of transmitting/receiving data between the data driver 130 and the controller 140 is suppressed so that the sensing and compensation failure is suppressed and an image abnormality due to the sensing and compensation failure is not generated.

It will be appreciated that various exemplary embodiments of the present disclosure have been described herein for purposes of illustration, and that various modifications, changes, and substitutions may be made by those skilled in the art without departing from the scope and spirit of the present disclosure. Further, the exemplary embodiments disclosed herein are intended to not limit but describe the technical spirit of the present disclosure and the scope of the technical spirit of the present disclosure is not restricted by the exemplary embodiments. The protection scope of the present disclosure should be interpreted based on the following appended claims and it should be appreciated that all technical spirits included within a range equivalent thereto are included in the protection scope of the present disclosure.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. An organic light emitting display device, comprising:

a display panel including a sub pixel;

a data driver coupled to the display panel, the data driver senses a characteristic parameter of the sub pixel and transmits a first clock signal and sensing data; and a controller coupled to the data driver, the controller receives the first clock signal and the sensing data, generates a second clock signal having a same phase as the first clock signal, generates compensation data based on the sensing data and applies the compensation data to image data, and transmits the compensated image data in accordance with the second clock signal to the data driver, wherein the controller generates a synchronization control signal that indicates whether the second clock signal is generated, and the controller transmits the synchronization control signal to the data driver, wherein the controller transmits the synchronization control signal having a low level to the data driver before generating the second clock signal and transmits the synchronization control signal having a high level to the data driver when the generation of the second clock signal is completed, and wherein the data driver stops outputting the first clock signal in response to receiving the synchronization control signal having the high level.

2. The organic light emitting display device according to claim 1, wherein the controller generates the second clock signal using the first clock signal which is received from the data driver.

3. The organic light emitting display device according to claim 1, wherein the data driver transmits the first clock signal and the sensing data during separate intervals.

4. The organic light emitting display device according to claim 1, wherein the data driver transmits at least a portion of the first clock signal and the sensing data concurrently.

5. A controller, comprising:

a receiving unit that receives a first clock signal and sensing data indicative of a sensed characteristic parameter of a sub pixel disposed in an organic light emitting display panel;

a clock signal generating unit that generates a second clock signal based on the received first clock signal;

a compensating unit that generates compensation data based on the received sensing data, and applies the compensation data to image data; and an output unit that outputs the compensated image data in accordance with the second clock signal to the data driver, wherein the output unit outputs a synchronization control signal that indicates whether the second clock signal is generated, wherein the output unit outputs the synchronization control signal having a low level before the clock signal generating unit generates the second clock signal and outputs the synchronization control signal having a high level when the clock signal generating unit generates the second clock signal, and wherein the receiving unit receives the first clock signal and the sensing data when the synchronization control signal has the low level, and the receiving unit receives the sensing data when the synchronization control signal has the high level.

6. The controller according to claim 5, wherein the clock signal generating unit generates the second clock signal having a same phase as the first clock signal.

7. The controller according to claim 5, wherein the receiving unit receives the first clock signal when the synchronization control signal has the low level, and the receiving unit receives the sensing data when the synchronization control signal has the high level.

8. The controller according to claim 5, wherein the controller receives the sensing data only when the synchronization control signal has the high level.

9. A method, comprising:

receiving, by a controller, a first clock signal and sensing data from a data driver, the sensing data indicative of a sensed characteristic parameter of a sub pixel in a display panel;

generating a second clock signal based on the first clock signal, the second clock signal having a same phase as the first clock signal;

generating compensation data based on the sensing data;

applying the compensation data to image data; outputting the second clock signal and the compensated image data, outputting a synchronization control signal having a low level before generating the second clock signal;

outputting the synchronization control signal having a high level when generation of the second clock signal is completed, receiving, by the data driver, the synchronization control signal having the low level; and transmitting the first clock signal, by the data driver;

receiving, by the data driver, the synchronization control signal having the high level; and ceasing transmission of the first clock signal, by the data driver, in response to receiving the synchronization control signal having the high level.

10. The method according to claim 9, wherein the first clock signal is received while outputting the synchronization control signal having the low level, and the sensing data is received while outputting the synchronization control signal having the high level.

11. The method according to claim 9, wherein the first clock signal and the sensing data are received while outputting the synchronization control signal having the low level, and the sensing data is received while outputting the synchronization control signal having the high level.

* * * * *